US005158716A

United States Patent [19]

Hirokane

[11] Patent Number: 5,158,716

[45] Date of Patent: Oct. 27, 1992

[54] ATOMIZER FOR HAIRDRESSING

[75] Inventor: Yasuyuki Hirokane, Nagoya, Japan

[73] Assignee: Sanko Electric Machine Manufacturer Co. Ltd., Aichi, Japan

[21] Appl. No.: 576,496

[22] PCT Filed: Mar. 30, 1989

[86] PCT No.: PCT/JP89/00338

§ 371 Date: Sep. 10, 1990

§ 102(e) Date: Sep. 10, 1990

[87] PCT Pub. No.: WO89/09000

PCT Pub. Date: Oct. 5, 1989

[30] Foreign Application Priority Data

Apr. 2, 1988 [JP] Japan ..... 63-81796
Apr. 2, 1988 [JP] Japan ..... 63-81797
Apr. 2, 1988 [JP] Japan ..... 63-81798

[51] Int. Cl.[5] ..... B01F 3/04

[52] U.S. Cl. ..... 261/142; 261/30; 261/38; 261/72.1; 261/DIG. 48; 132/272

[58] Field of Search ..... 132/272; 261/142, DIG. 48, 261/81, 30, 72.1

[56] References Cited

U.S. PATENT DOCUMENTS

| | | | |
|---|---|---|---|
| 3,387,607 | 6/1968 | Gauthier et al. | 261/DIG. 48 |
| 3,511,236 | 5/1970 | Conlin et al. | 261/142 |
| 3,561,444 | 2/1971 | Boucher | 261/DIG. 48 |
| 3,901,443 | 8/1975 | Mitsui et al. | 261/DIG. 48 |
| 3,974,840 | 8/1976 | Doyle et al. | 132/272 |
| 4,031,171 | 6/1977 | Asao et al. | 261/DIG. 48 |
| 4,060,576 | 11/1977 | Grant | 261/142 |
| 4,172,105 | 10/1979 | Miller et al. | 261/72.1 |
| 4,201,204 | 5/1980 | Rinne et al. | 261/142 |
| 4,292,985 | 10/1981 | Itogawa et al. | 132/272 |
| 4,297,563 | 10/1981 | Berry | 261/142 |
| 4,352,248 | 10/1982 | Kobayashi | 261/DIG. 48 |
| 4,365,952 | 12/1982 | Ohmukai et al. | 261/142 |
| 4,731,204 | 3/1988 | Noma et al. | 261/DIG. 48 |
| 5,010,905 | 4/1991 | Synder et al. | 261/DIG. 48 |

FOREIGN PATENT DOCUMENTS

| | | | |
|---|---|---|---|
| 0021666 | 1/1981 | European Pat. Off. . | |
| 965120 | 5/1957 | Fed. Rep. of Germany . | |
| 2180958 | 11/1973 | France . | |
| 5225335 | 8/1975 | Japan . | |
| 53-37806 | 4/1978 | Japan . | |
| 54-43907 | 4/1979 | Japan . | |
| 0056236 | 5/1979 | Japan | 261/DIG. 48 |
| 58-16322 | 4/1983 | Japan . | |
| 58-27922 | 6/1983 | Japan . | |
| 60-31607 | 9/1985 | Japan . | |
| 61-25427 | 2/1986 | Japan . | |
| 61-35912 | 2/1986 | Japan . | |
| 0218759 | 9/1987 | Japan | 261/DIG. 48 |
| 0196435 | 8/1989 | Japan | 261/DIG. 48 |
| 2018585 | 10/1979 | United Kingdom . | |

*Primary Examiner*—Tim Miles
*Attorney, Agent, or Firm*—Oliff & Berridge

[57] ABSTRACT

This invention discloses an atomizer for hairdressing which generates micro-size liquid particles by means of electricity-mechanical power conversion elements as a source of ultrasonic wave. The atomizer for hairdressing of this invention intakes air and forcibly send it into a path made of an elastic member. Then it generates minute-diameter liquid particles from the surface of a stored liquid by means of the vibration of the electricity-mechanical power conversion means. Those liquid particles are heated and inducted into the above-mentioned path. The micro-size liquid particles having a diameter of several μm or less generated by the ultrasonic vibration can be controlled at a predetermined temperature. Moreover, the particles can be blown out independently or with hot or cool air.

5 Claims, 14 Drawing Sheets

ATOMIZER FOR HAIRDRESSING

FIELD OF THE INVENTION

This invention relates to an improved atomizer for hairdressing in which micro-size liquid particles are generated by utilizing an electricity-mechanical power conversion element as a source of ultrasonic waves.

BACKGROUND OF THE INVENTION

To protect hair from damage such as peeling of the cuticle and splitting and tearing of the hair, and also to favorably keep the natural gloss of the hair itself, it is generally known that the moisture contained in hair (hereinafter referred to as "hair moisture content") should be maintained at an optimum value, i.e., approximately 10% in relation to the weight of hair.

To perform hairdressing without losing the hair moisture content, drying or dressing of the hair is carried out by means of various hot air dryers (represented by a hand dryer) after shampoo or water spraying to moisten the hair. Though it is effective to apply moisture to the cuticle of the hair to make hairdressing easier, most of the moisture is collected on the cuticle of the hair by surface tension of the water particles generated on the cuticle of the hair. As a result, the moisture applied to the hair steams away during drying of the hair. Namely, since the volume of the moisture to permeate into the hair only by moistening the hair is very small, it is hard to protect the hair and to maintain the gloss of the hair because the hair moisture content to be lost by drying cannot be sufficiently supplemented.

To solve this problem, various dryers which are provided with steam atomizers for atomizing water steam particles (hereinafter referred to as "steam") to the hair have been proposed. For example, a dryer in which a steam atomizer is installed in the controlling portion is disclosed in Japan Published Examined Utility Model Application No. 52-25335. A dryer in which the steam atomizer and the controlling portion are separately formed is disclosed in Japan Published Examined Utility Model Application No. 54-43907. Moreover, a dryer which is provided with a pot-type hard hood is disclosed in Published Examined Utility Model Application No. 53-37806.

In the above-mentioned prior references, since hot steam is atomized to the cuticle of the hair, hairdressing to straighten out kinky hair and curl hair during applying a permanent can be facilitated. Moreover, since the steam to be sprayed includes more minute water particles in comparison with spraying water, the volume of the moisture content to be permeated into the hair is increased. As a result, the moisture content (the ideal volume of the moisture contained in the hair is approximately 10% in relation to the weight of the hair) to be lost due to hot air drying can be effectively supplemented to protect the hair from damage and to keep the gloss of the hair.

On the other hand, the steam particles having an average diameter of approximately 30 to 50 μm are a few μm larger than those considered to be ideal to permeate into the hair. Therefore, the permeation of the moisture into the hair is insufficient even if steam is sprayed. Namely, the aforementioned ideal value of the hair moisture has not been attained yet.

Moreover, the temperature of the spraying steam is so high that there is a possibility of being scalded due to spraying of hot steam onto the face, dropping of hot water drops collected at the atomizer end portion, and long time spraying of steam. Especially, in case of a dryer in which the steam atomizer is installed in its controlling portion, it is apprehended that hot water may flow out. On the other hand, in a dryer which is provided with a pot type hard hood, a steam blow-out hole is installed in the hard hood in order to prevent the user from getting scalded. This type, however, is still insufficient to prevent the occurrence of scald. If the head of the user touched at the hood, there is still a possibility of getting scalded.

Furthermore, the prior art dryers include another problem. If the temperature of the steam is decreased, the steam particles become water drops. It is, therefore, necessary to keep the temperature of the steam near 100 ° C. even in the case when such a high temperature steam is not necessary. The high temperature may result in deteriorating the elasticity of the hair more than expected.

A mist atomizer for generating water particles (hereinafter referred to as "mist") by means of the ultrasonic vibration based on an electricity-mechanical power conversion element such as a piezoelectric vibration element to atomize the mist into a predetermined space is disclosed in Published Examined Patent Application No. 61-35912 and Published Examined Patent Application No. 61-25427.

According to this prior art mist atomizer, the mist having a minute particle diameter is effectively sprayed into the air, so that the favorable humidification by the floating mist and the improvement of burning efficiency can be realized.

The mist sprayed from the mist atomizer has no possibility of scald, and the particle is more minute than that of the steam. The diameter of the mist particle, however, has not been unified into the size that is appropriate for permeating into the hair or that allows the floating of the mist particles in the air for a long time. Accordingly, even if the mist atomizer is used during drying the hair by hot air, the hair moisture content can not be sufficiently supplemented. In detail, the mist particles of large diameter contained in the spraying mist will collide with the cuticle of the hair, and easily become water drops. As a result, other mist particles in a small diameter will cause a chain reaction to be merged into the water drops composed of the large-diameter particles. When the mist is changed into the water drops on the hair cuticle, the water drops are collected on the hair cuticle due to the act of surface tension. Those collected water drops steam away due to the hot air, so that the volume of the moisture to permeate into the hair becomes small. Moreover, to prevent the steam from changing into the water drops by decreasing the temperature of the steam, the temperature of the steam shall be kept at approximately 100° C. even in the case that such a hot mist is not required. As a result, the elasticity of the hair is deteriorated more than expected.

The mist sprayed from the mist atomizer can be quickly obtained in comparison with steam. Since the particle diameter is minute, it is appropriate to supplement the hair moisture content. On the other hand, since the temperature of the mist to be sprayed is as low as that of water, it may decrease the temperature of the hot air of the hair dryer or the room temperature increased by a heater, etc. though there is no possibility of being scalded. Moreover, when it is used for the spraying of fuel, it takes a relatively long time to catch fire.

Even if a certain heating unit which is installed in a hot air dryer such as a hand dryer is provided to the route of the mist in the above-mentioned mist atomizer, it is hard to increase the temperature of the mist up to a desired temperature because the specific heat of the mist is higher than that of the air.

One object of the present invention is to provide an atomizer for hair dressing to be used for applying moisture to the hair to facilitate the hair dressing operation, in that the moisture is permeated into the hair to supplement the loss of the hair moisture content to keep it at the ideal value and thus to protect the hair from damages while drying the hair, and moreover the water particle controlled at the ideal temperature can be sprayed without fear of scald.

Another object of the present invention is to provide an atomizer which enables the spraying of liquid particles whose diameter is unified into a minute size less than a few μm.

A further object of the present invention is to provide an atomizer in which the temperature of the liquid particles having a micro-size diameter can be increased up to a desired temperature without fear of being scalded, and moreover the liquid particles kept at the desired temperature can be sprayed.

A still further object of the present invention is to provide an atomizer for hair dressing which provides a variety of usages such as perming, coloring, treatment and nourishment of the hair, facial steaming, etc.

DISCLOSURE OF THE INVENTION

To achieve the above-mentioned objects, the present invention adopts the means of a first embodiment as set forth below. Namely, as shown in the fundamental structure drawing of FIG. 1A;

an air feeding means M1 for intaking air and for forcibly feeding the air;

an air ventilating means M2 for forming an air path in which air is fed by the above-mentioned air feeding means M1;

an end heating means M3 which is installed in an air blow-out hole of the air ventilating means M2 for optionally heating the air passing through the path;

a liquid particle generating means M4 which is provided with an electricity-mechanical power conversion element for oscillating the collected liquid to generate liquid particles having a micro-size diameter from the surface of the collected liquid; and a liquid particle heating and inducting means M5 which is provided between the liquid particle generating means M4 and the air ventilating means M2 for optionally heating the liquid particles generated by the liquid particle generating means M4 and for inducting those particles into the path formed by the air ventilating means M2.

The air feeding means M1 of the atomizer for hairdressing of the present invention functions to forcibly feed the intake air. The air fed by the air feeding means M1 passes through the path formed by the air ventilating means M2 which is composed of an elastic member, and reaches the end heating means M3 installed in the blow-out portion of the air ventilating means M2. The end heating means M3 functions to optionally heat the air passing through the path of the air ventilating means M2.

On the other hand, the liquid particle generating means M4, which is provided with the electricity-mechanical power conversion element for oscillating the collected liquid, generates the liquid particles having a micro-size diameter from the surface of the above-mentioned collected liquid by means of the oscillation of the element. The generated liquid particles are optionally heated up to a predetermined temperature by the liquid particle heating and inducting means M5 provided between the liquid particle generating means M4 and the air ventilating means M2. Then, the particles are conducted into an optional portion in the path of the air ventilating means M2. Accordingly, the cold air, the air heated by the end heating means M3 including cold liquid particles, or the liquid particles heated by the liquid particle heating and conducting means M5 is blown out from the end heating means M3.

To achieve the above-mentioned objects, a second embodiment of the present invention adopts the means set forth below. Namely, as shown in the fundamental structure drawing of FIG. 1B, an atomizer of this invention includes:

a liquid particle generating means M1 which is provided with an electricity-mechanical power conversion element for oscillating the liquid collected in a tank up to a predetermined level to generate minute-diameter liquid particles from the surface of the collected liquid at a predetermined water level by oscillating the electricity-mechanical power conversion element;

a supplement means M2 for supplementing liquid to the liquid particle generating means M1;

a water level detecting means M3 for detecting the level of the collected liquid;

a conversion element control means M4 for actuating and controlling the electricity-mechanical power conversion element of the liquid particle generating means M1 based on the result detected by the water level detecting means M3;

a space dividing means MI for dividing the space above the surface of the collected water in the water tank of the liquid particle generating means M1 into the upper and the lower spaces;

a path constructing means MII for constructing a path for partially connecting the lower space and the upper space by penetrating the dividing portion;

an air supply means MIII for supplying air to the lower space; and a blow-out hole MIV which is provided on the side wall of the tank for directly connecting the upper space and the outside air.

On the other hand, a third embodiment of the present invention includes the following means. Namely, as shown in the fundamental structure drawing of FIG. 1C, the atomizer of this invention includes:

a liquid particle generating means M1 which is provided with an electricity-mechanical power conversion element for oscillating the liquid collected in a tank up to a predetermined level to generate minute-diameter liquid particles from the surface of the collected liquid at a predetermined water level by oscillating the electricity-mechanical power conversion element;

a supplement means M2 for supplementing the liquid to the liquid particle generating means M1;

a water level detecting means M3 for detecting the level of the collected liquid;

a conversion element control means M4 for actuating and controlling the electricity-mechanical power conversion element of the liquid particle generating means M1 based on the result of the water level detecting means M3; wherein the supplement means M2 includes a supplement liquid storing portion M2I for storing the liquid to be supplemented to the liquid tank of the liquid particle generating means M1;

a supplement liquid path M2II extending from the portion below the bottom of the liquid tank to the liquid tank for passing the liquid in the liquid tank;

a supplement liquid pumping portion M2III which is provided between the supplement liquid path M2II and the supplement liquid storing portion M2I, for pumping the liquid stored in the supplement liquid storing portion M2I to the supplement liquid path M2II in response to the predetermined liquid level of the liquid tank; and a drain pipe M2IV formed at the lowest portion of the supplement liquid path M2II, which is optionally opened and closed.

An atomizer of a fourth embodiment of the present invention includes the means as shown in the fundamental structure drawing of FIG. 1D. Namely, the atomizer includes:

a liquid particle generating means M1 which is provided with an electricity-mechanical power conversion element for oscillating the liquid collected in a tank up to a predetermined level to generate minute-diameter liquid particles from the surface of the collected liquid at a predetermined water level by oscillating the electricity-mechanical power conversion element;

a supplement means M2 for supplementing the liquid to the liquid particle generating means M1;

a water level detecting means M3 for detecting the level of the collected liquid;

a conversion element control means M4 for actuating and controlling the electricity-mechanical power conversion element of the liquid particle generating means M1 based on the result detected by the water level detecting means M3; wherein the liquid level detection means M3 includes a wave motion interrupting means M3I for interrupting the wave motion generated on the surface of the liquid in the tank from being transmitted within a predetermined range of the liquid surface; and a liquid level detecting portion M3II for detecting the liquid level of the above-mentioned predetermined range of the wave motion interrupting means M3I.

The liquid particle generating means M1 of the atomizer of the second embodiment stores the liquid supplied by the supplement means M2 up to a predetermined level of the liquid tank, and transmits the vibration of the electricity-mechanical power conversion element to the liquid, thereby generating the minute-diameter liquid particles from the surface of the stored liquid. The generated liquid particles move up from the lower space to the upper space, which spaces are divided by the space division means M1 by passing through the path formed by the path construction means MII for partially communicating the lower space and the upper space.

Moreover, the air supply means MIII supplies air to the lower space to activate the rising of the generated liquid. At the same time, the air supply means MIII blows out the liquid particles from the path into the upper space in various directions, so that the liquid particles are blown upon the side and the upper surfaces of the upper space. The liquid particles which move up and occupy the upper space are blown out from the blow-out hole IV formed on the side surface of the liquid tank. On the other hand, the liquid level of the liquid tank detected by the liquid level detection means M3 is output to the conversion element control means M4. Based on this result, the conversion element control means M4 actuates the electricity-mechanical power conversion element, and controls the volume of the liquid particles to be generated.

The atomizer of the third embodiment generates liquid particles from the liquid stored in the liquid tank by utilizing the oscillation of the electricity-mechanical power conversion element of the liquid particle generating means M1. The volume of the liquid particles to be generated is adjusted by the liquid level detection means M3 for detecting the level of the liquid stored in the tank and the conversion element control means M4 for actuating and controlling the electricity-mechanical power conversion element based on the detected result. Moreover, the supplement liquid pumping means M2III of the supplement means M2 feeds the liquid stored in the supplement liquid tank M2I in response to the predetermined level of the tank of the liquid particle generating means M1, by means of the supplement liquid path M2II extending from the portion below the bottom of the liquid tank to the liquid tank. All of the liquid in the supplement liquid path M2II is discharged by opening the open/close drain pipe M2IV formed at the lowest portion of the supplement liquid path M2II.

The atomizer of the fourth embodiment generates the liquid particles from the surface of the liquid in the tank supplied by the supplement means M2 by means of the oscillation of the electricity-mechanical power conversion element of the liquid particle generating means M1. Moreover, the wave motion interrupting means M3I installed in the liquid level detection means M3 interrupts the wave motion generated on the liquid surface from spreading within a predetermined range so as to prevent the wave motion from affecting the liquid level in the above-mentioned predetermined range. On the other hand, the liquid level detection portion M3II of the liquid level detecting means M3 detects the liquid level in the predetermined range of the wave motion interrupting means M3I as the liquid level of the tank. Based on this result, the conversion element control means M4 actuates the electricity-mechanical power conversion element and controls the volume of the liquid particles to be generated.

To achieve the above-mentioned objects, an atomizer of a fifth embodiment adopts the means as shown in the fundamental structure drawing of FIG. 1E. Namely, the atomizer of the fifth embodiment includes:

a liquid particle generating means M1 which is provided with an electricity-mechanical power conversion element for oscillating the liquid collected in a tank to generate minute-diameter liquid particles M from the surface of the collected liquid at a predetermined level by oscillating the electricity-mechanical power conversion element;

a liquid particle blowing means M2 for inducting the liquid particles M generated by the liquid particle generating means M1 into a blowing path R and for blowing out the liquid particles from the blow-out hole with the flow of the air passing through the air path R; and a heating means M3 which is provided along the air path R of the liquid particle blowing means M2.

As shown in the fundamental structure drawing, FIG. 1F, a sixth embodiment of the invention shows the atomizer of the first embodiment in that the air path R of the liquid particle blowing means M2 is bent in the upstream side of the heating means M3 which is provided in the air path R.

A seventh embodiment of invention represents an atomizer of the first or second embodiments including the means as shown in the fundamental structure drawings FIGS. 1G and 1H. Namely, the effective diameter of the blowing path in the range in which the heating means M3 is arranged is larger than that of the path in the upper stream side.

An eighth embodiment of shows the atomizer of the first, second or third embodiment including the means as shown in the fundamental structure drawings of FIGS. 1I, 1J, 1K and 1L. Namely, the effective diameter of the blowing path in the range in which the heating means M3 is arranged is larger than that of the path in the lower stream side.

The liquid particle generating means M1 of an atomizer based on the inventions of the fifth, sixth, seventh or eighth embodiments generates the minute-diameter liquid particles M from the surface of the collected liquid by oscillating the electricity-mechanical power conversion element. The generated liquid particles M are inducted into the blowing path R by the liquid particle blowing means M2.

Since the heating means M3 of the atomizer of the fifth embodiment is in the form of a long strip, the distance of the blowing path R of the liquid particle blowing means M2 for arranging the heating means M3 is long. Since it takes time for the liquid particles M to pass through the blowing path in the above-mentioned distance, the liquid particles M are heated by the heating means M3 before being blown out from the blow-out hole.

The bent blowing path R of the atomizer shown in the sixth embodiment disturbs the flow of the air in the downstream side from the bent portion. Accordingly, it takes time for the liquid particles M to pass through the blowing path R in the downstream side from the bent portion. In the downstream side from the bent portion, the liquid particles are heated by the long strip type heating means M3, and blown out from the blow-out hole.

The blowing path R of the atomizer of the seventh embodiment, having the larger effective diameter, retains the liquid particles M flown from the upstream side of the path having the smaller effective diameter within its larger-diameter path for a long time. Namely, it takes time for the liquid particles M to pass through the blowing path R in the larger effective diameter. The liquid particles M are heated by the long strip type heating means M3 which is arranged in the large-diameter path R, and blown out from the blow-out hole.

The blowing path R of the atomizer of the eighth embodiment having the smaller effective diameter, regulates the inflow of the liquid particles M from the larger effective diameter path R, and retains the liquid particles in the larger-diameter path R for a long time. Namely, it takes a long time for the liquid particles M to pass through the large-diameter air path R. The liquid particles M are heated by the long strip type heating means M3 arranged in the large-diameter air path, and blown out from the blow-out hole.

BEST MODE FOR CARRYING OUT OF THE INVENTION

The explanation of a preferred embodiment of the present invention is set forth below in reference to the drawings.

Figure 1A:
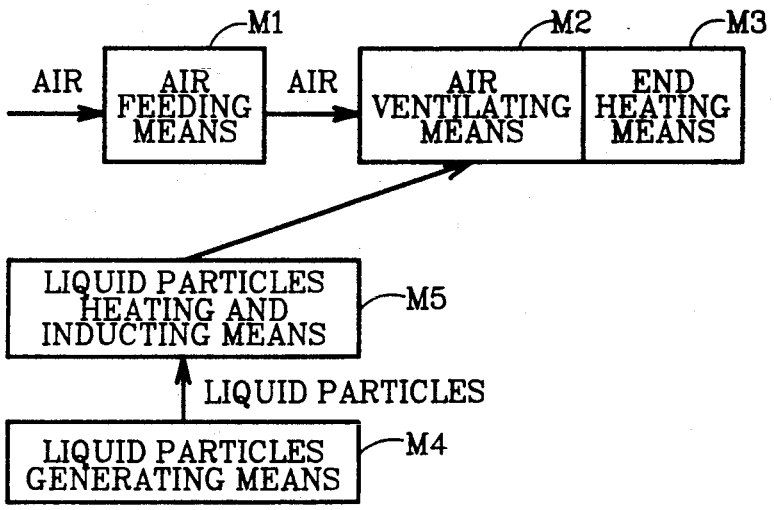
FIGS. 1A, 1B, 1C, 1D, 1E, 1F, 1G, 1H, 1I, 1J, 1K and 1L are block diagrams showing the fundamental structure of the present invention.
Figure 1B:
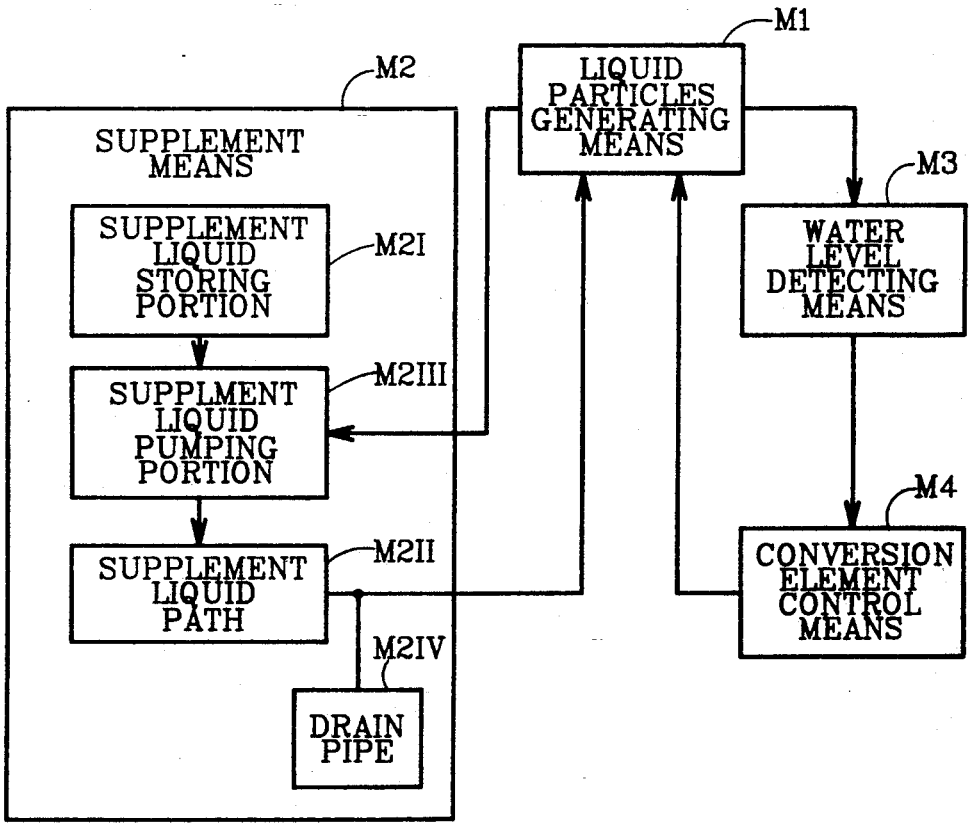
Figure 1C:
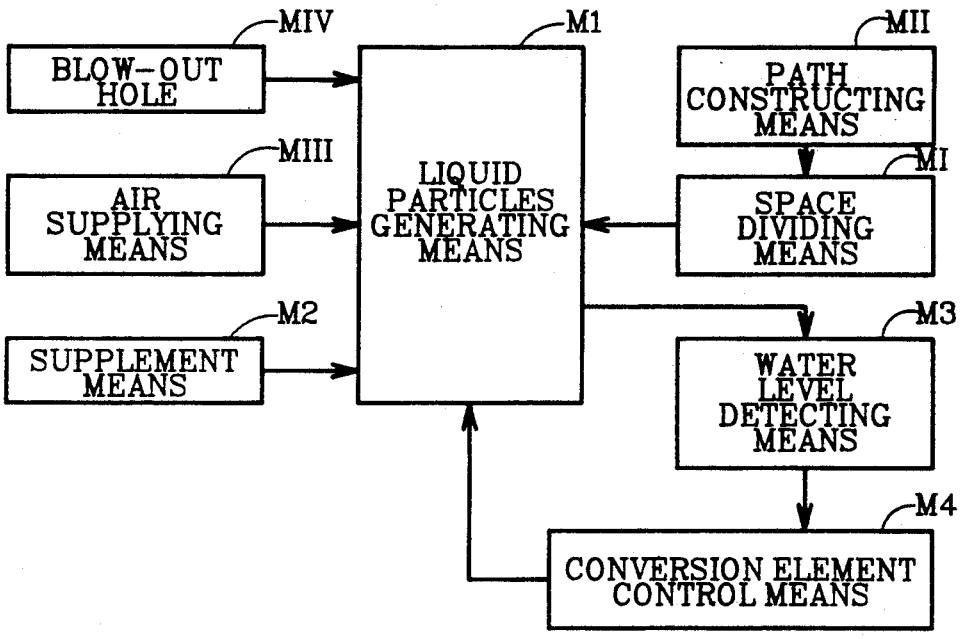
Figure 1D:
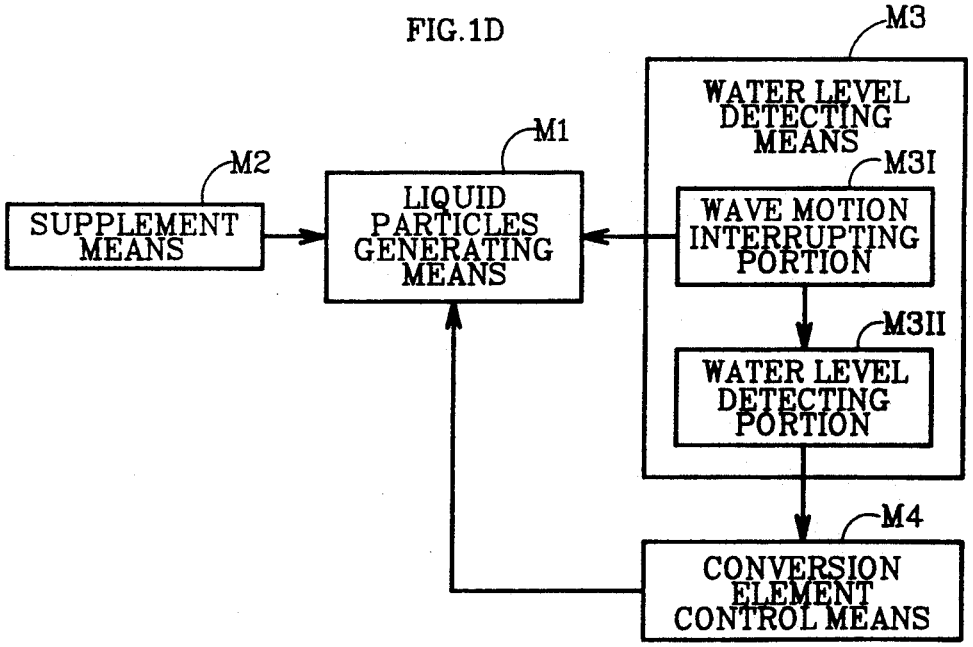
Figure 1E:
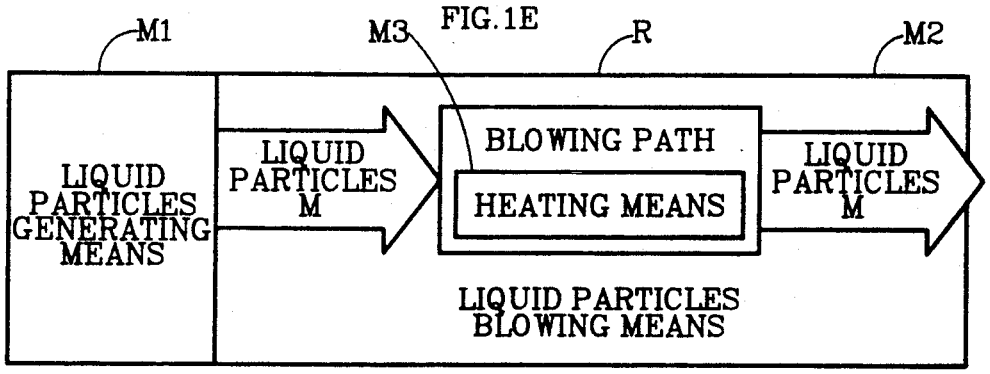
Figure 1F:
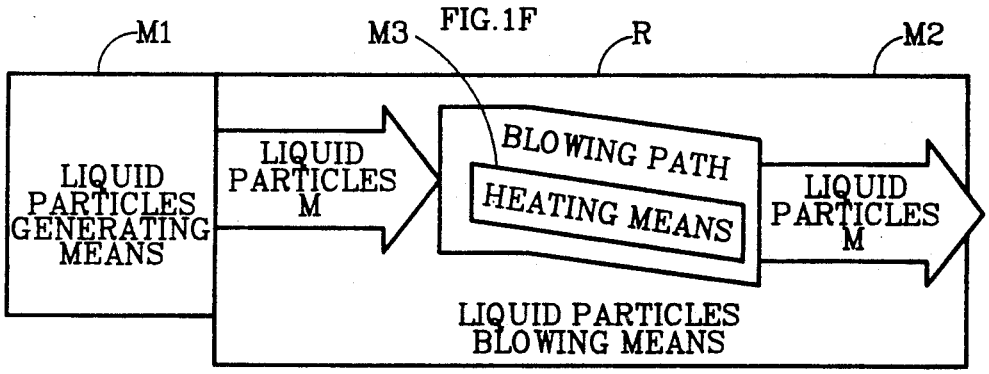
Figure 1G:
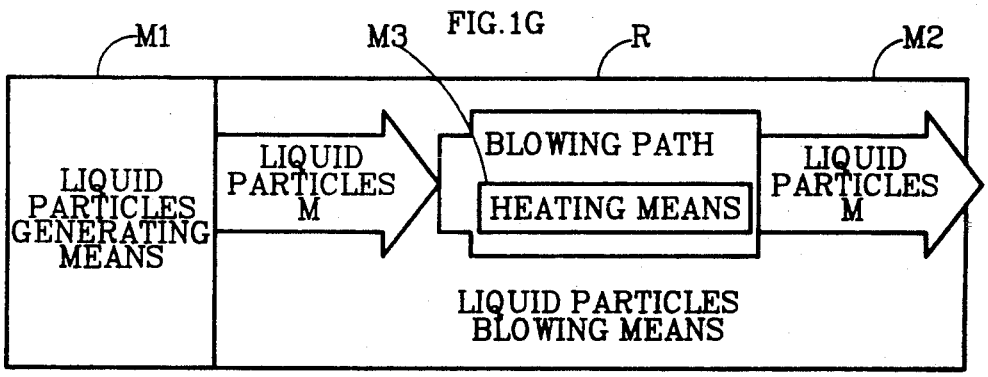
Figure 1H:
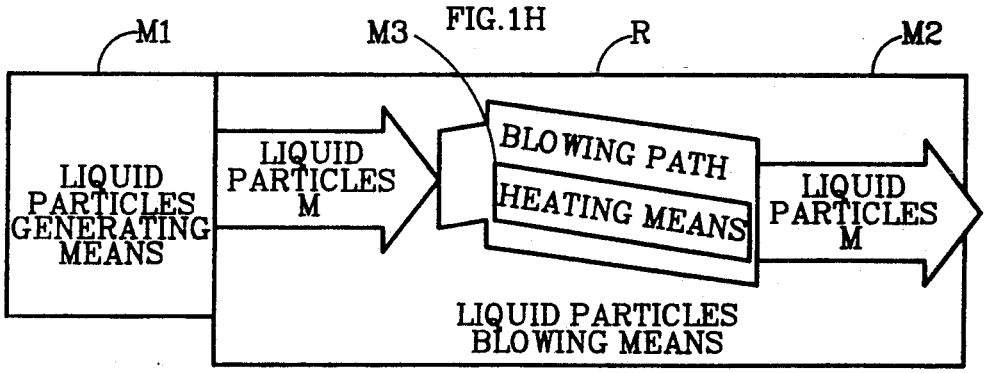
Figure 1I:
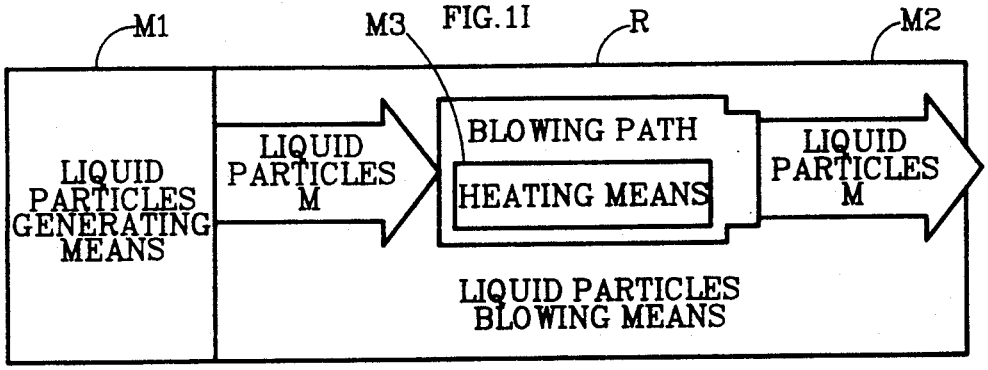
Figure 1J:
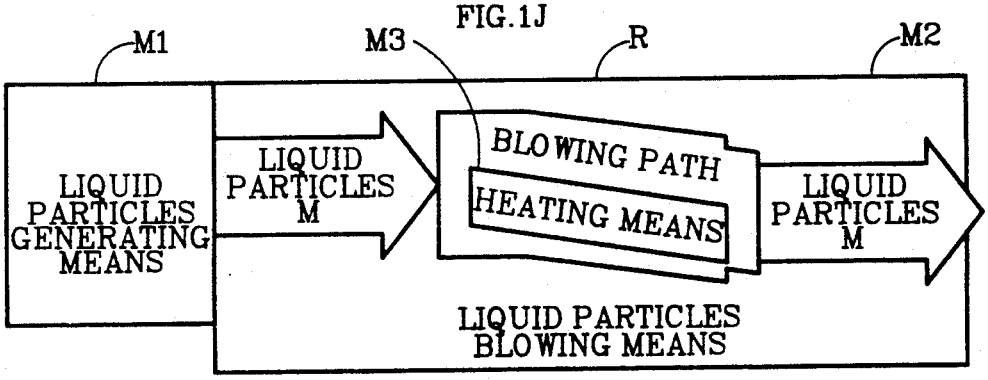
Figure 1K:
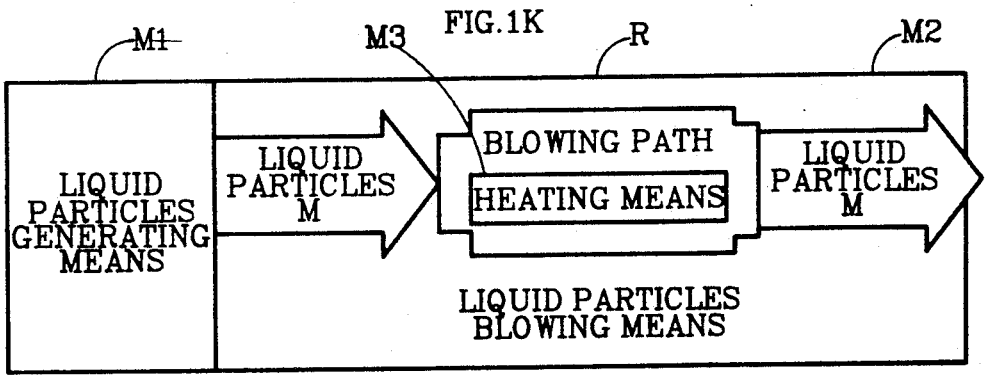
Figure 1L:
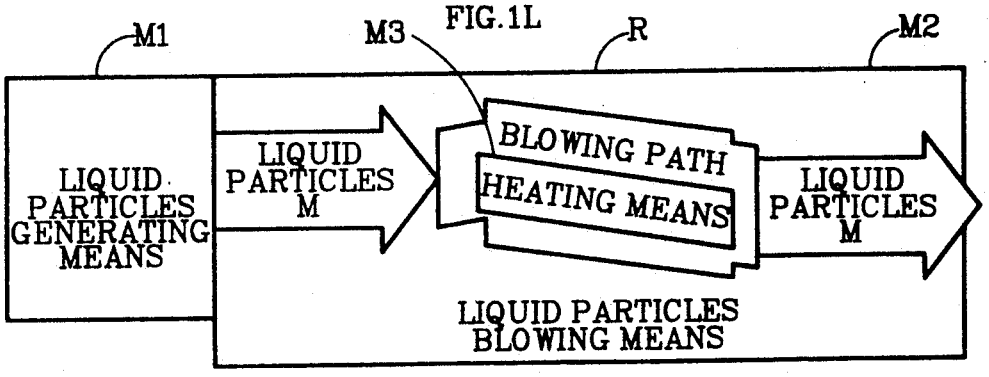
Figure 2:
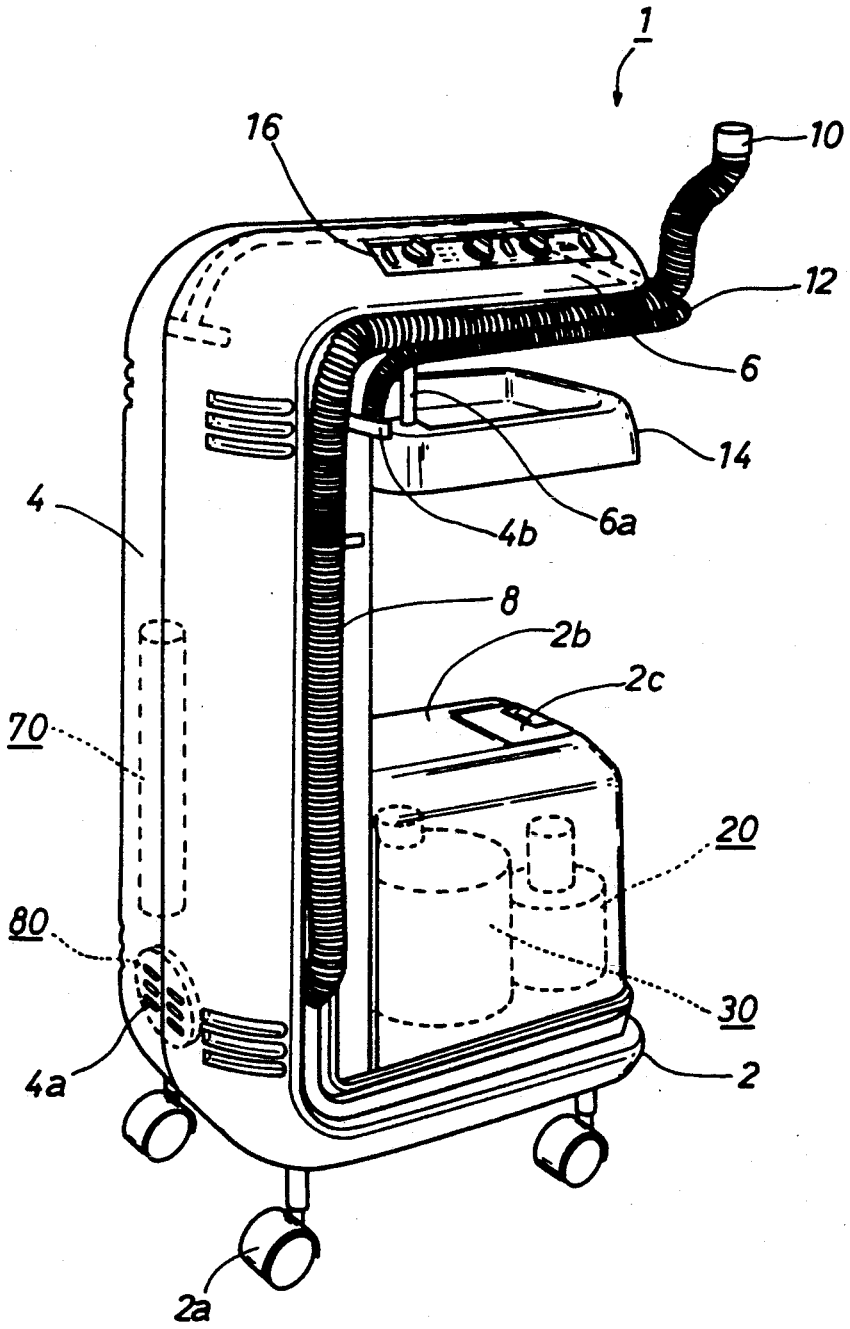
FIG. 2 is a perspective view of a mist blower of an embodiment of the present invention.

FIG. 2 is a perspective view of an atomizer for hairdressing (hereinafter referred to as "mist blower") 1 of the present embodiment. As shown in the figure, the mist blower 1 has a shape of the letter-U which is composed of a water tank 20 (to be described later), a base 2 on which a mist generating bath 30 is set, a side wall 4 (to be described later) extending from one end of the base 2, in which a mist heater 70 and an outside air blower 80 (to be described later) are stored, and an upper seat 6 projecting from the upper end of the side wall 4 in parallel to the base 2.

On the bottom surface of the base 2, four casters 2*a* are provided, so that the mist blower 1 is freely movable on the floor. Moreover, the base 4 is equipped with a removable base cover 2*b*. At the corner of the base cover 2*b*, a cap 2*c* is provided for putting in and removing a water supply container 24 for supplying water to the water tank 20.

On the side wall 4, a number of air inlets 4*a* are formed to supply air into the outside air blower 80. Moreover, a flexible outer hose 8 which stores a mist hose 66 (to be described later) extends from the side surface. At the end of the flexible outer hose 8, a removable end cylindrical member 10 is provided so that various types of attachments can be attached to it. The length of the outer hose 8 extending from the side wall to the end cylindrical member 10 is appropriate for a hair dressing staff to perform hairdressing operations with the end cylindrical member 10 in his or her hand. Moreover, since the end cylindrical member 10 has a light weight, a load to be applied to the hand of the hairdressing staff can be reduced. On the other hand, a pair of rotatable handle attachments 4*b* is provided on the upper part of both sides of the side wall 4. Moreover, both ends of a U-shaped handle 12 are connected to this pair of handle attachments 4*b*. Though the handle 12 is normally fixed at the position along the upper seat 6 as shown in the figure, it can be fixed orthogonally to the illustrated position by rotating the handle 12 around the handle attachment 4*b*. The flexible outer hose 8 is normally stored between the handle 12 and the upper seat 6.

Under the upper seat 6, a tray 14 in which various attachments can be stored is provided. The tray 14 is rotatable around a leg 6*a* extending from the root of the upper seat 6. Moreover, a control unit 16 is set at one corner of the upper seat 6 to execute various controls including actuation of the outside air blower 80 and adjustment of the volume of the mist to be generated.

Figure 3A:
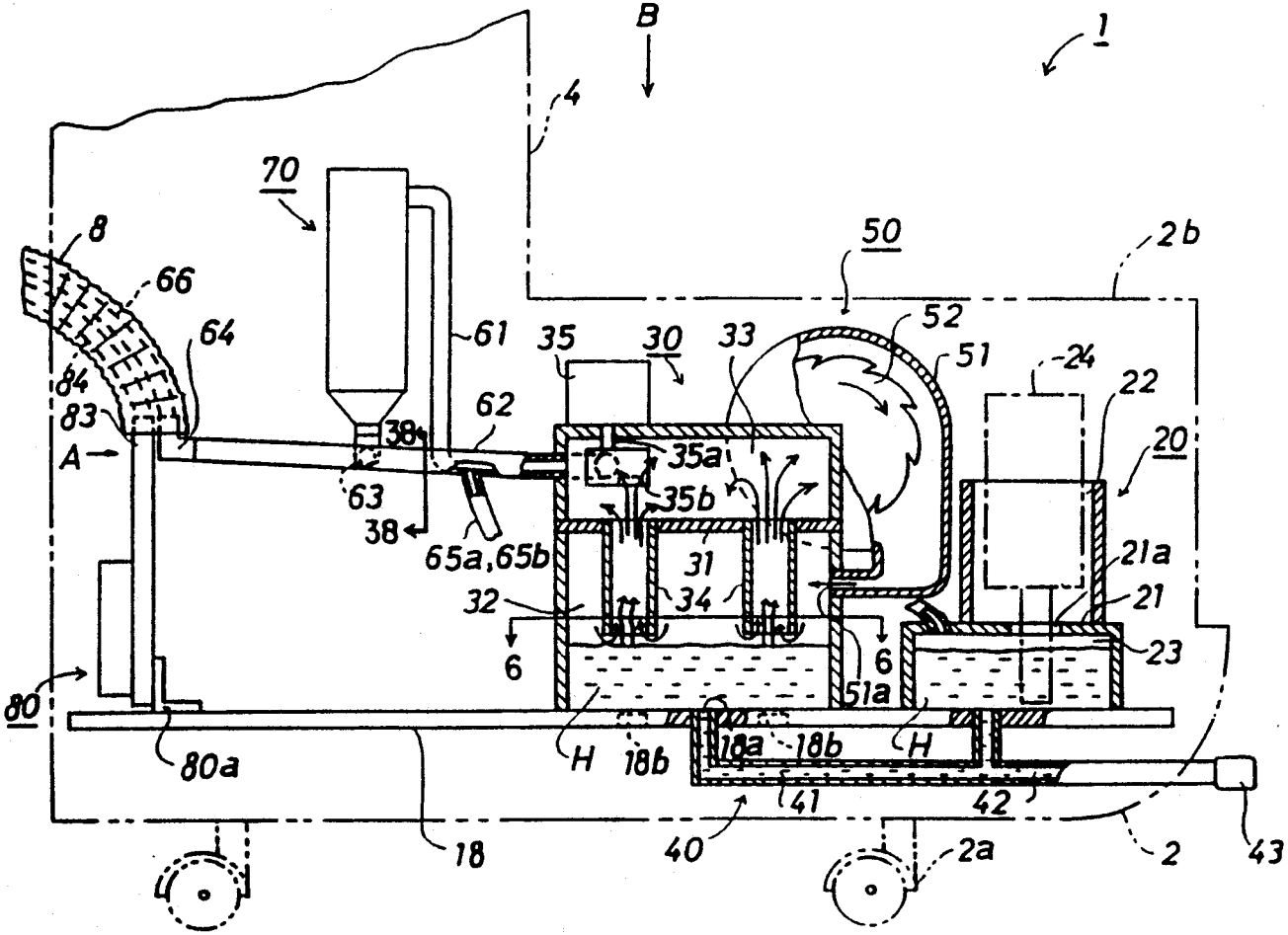
FIG. 3A is a side view showing a main part of the mist blower including its sectional view.
Figure 3B:
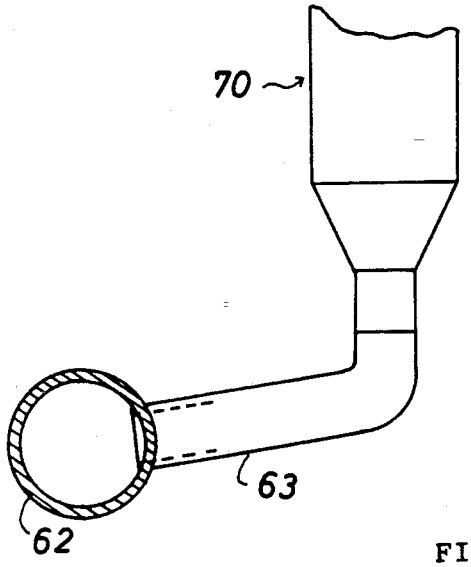
FIG. 3B is a sectional view taken along line 3B—3B of FIG. 3A.
Figure 3C:
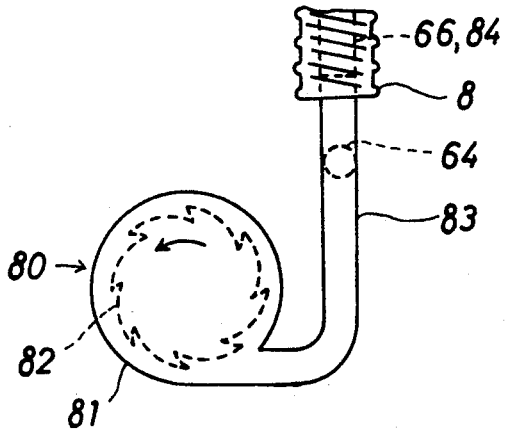
FIG. 3C is a view in the direction of arrow A of FIG. 3A.
Figure 4:
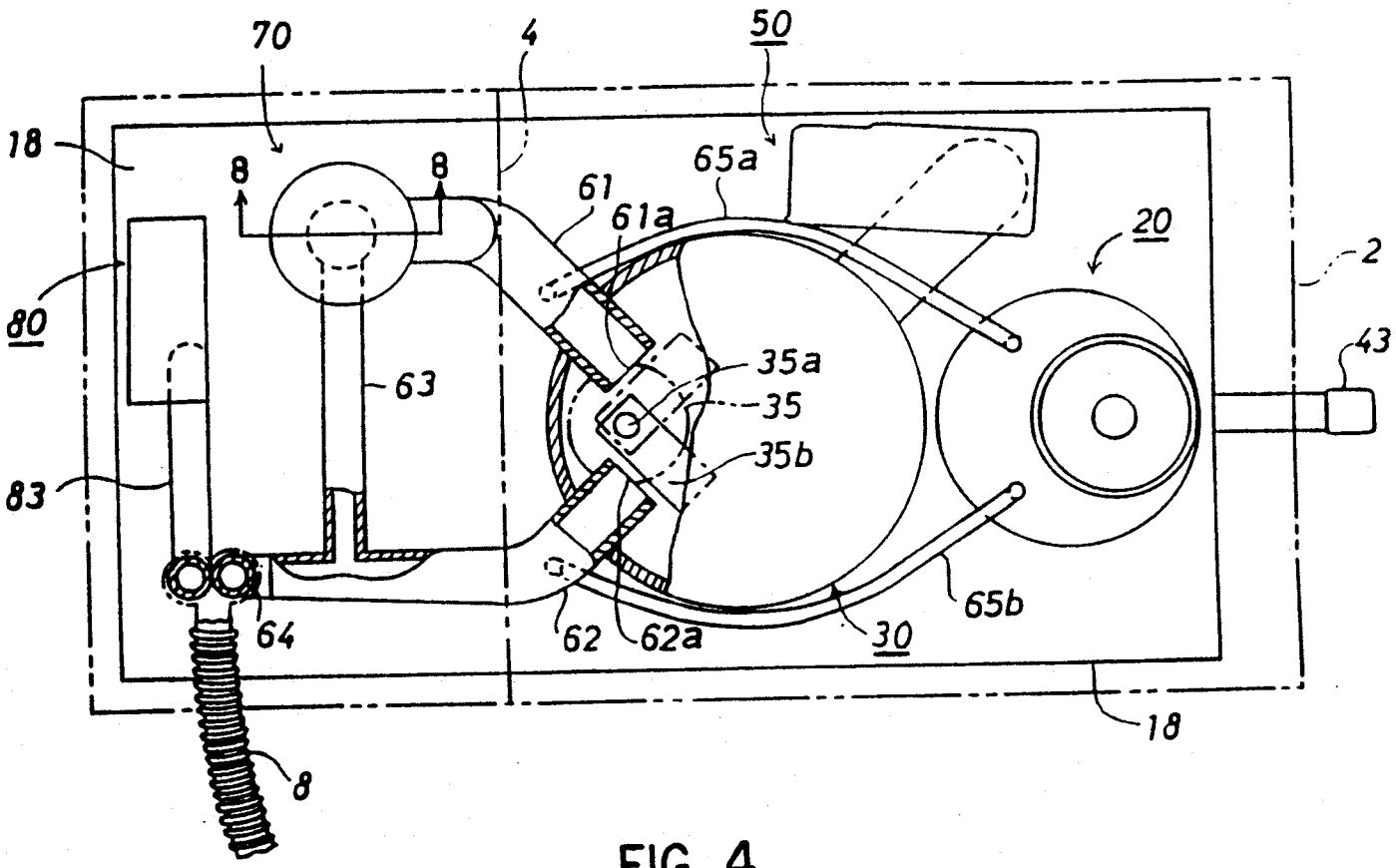
FIG. 4 is a view in the direction of arrow B partially including the sectional view of FIG. 3A.
Figure 5A:
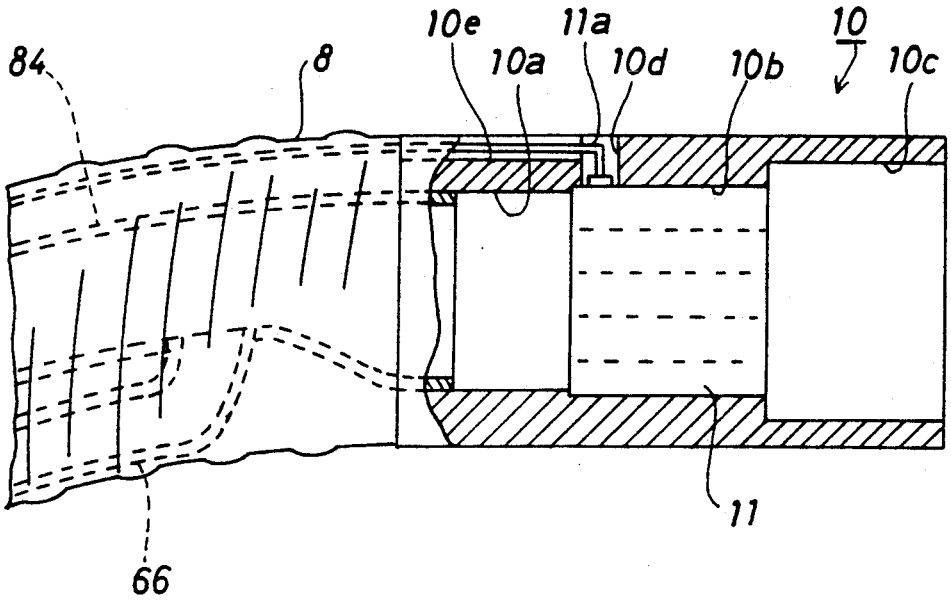
FIG. 5A is a cross-sectional view showing a main part of a component of the mist blower.

Detailed explanation of various components are set forth below. FIG. 3A is a side view of a main part of the mist blower 1 including its sectional view. FIG. 3B is a cross-sectional view taken along line 3B—3B of FIG. 3A. FIG. 3C and FIG. 4 respectively show the views in the directions of arrow A and arrow B of FIG. 3A. FIG. 5 is a side view of the end cylindrical member 10 partially including its sectional view.

As shown in FIG. 3A, on a plate 18 which is fixed on the base 2, the water tank 20 and the closed mist generating tank 30 are formed. The water tank 20 is divided into a tank holding chamber 22 and a supplement water storage chamber 23 by an intermediate plate 21 which is equipped with a through hole 21*a* in its center. The mist generating tank 30 is also divided into the upper and the lower chambers by a partition board 31. The lower chamber is a water storage chamber 32 and the upper chamber is a mist storage chamber 33. In the tank holding chamber 22, a water supply container 24 for optionally supplying a predetermined volume of water is installed.

A communicating path 41 for connecting the mist generating tank 30 and the water tank 20 at the position under the bottom of those tanks is provided under the plate 18. Moreover, a water supply/drain pipe 40, one end of which is communicating with the path 41 and the other end of which is protruding outside the base 2 to form a drain pipe 42, is also provided. An open/close type drain valve 43 is attached to the end of the drain pipe 42 of the water supply drain pipe 40. The water H supplied from the water supply/drain pipe 40 flows into the supplement water inlet 18*a* at the center of the bottom of the mist generating tank 30 and is stored in the water storage tank 32. On the other hand, hair and dust are collected in the communicating path 41 of the water supply/drain pipe 40 or the drain pipe 42, so that contaminants never enter the water storage chamber 32. Dust can be easily taken out from the drain valve 43. Moreover, the position where the intermediate board 21 is located is slightly higher than the surface of the water stored in the supplement water storage chamber 23, so that an unexpected change of the water level can be controlled.

The mist generating tank 30 is equipped with a mist blower 50 for blowing a small amount of air to an attachment (not shown). One end of a casing 51 of the mist blower 50 penetrates the side wall of the water storage chamber 32 to connect the inside of the casing 51 and the water storage tank 32. A fan 52 installed to be pivotally movable in the casing 51 is rotated by a motor (not shown) in the direction of the arrow in the figure to feed air from an air hole 51*a* in the casing 51 into the water storage chamber 32. Thus, the minute-diameter water particles (hereinafter referred as "mist") are generated from the surface of the water H stored in the water storage chamber 32 by the intake air and the vibration of ultrasonic vibration element 18*b* provided on the plate 18. Then the mist penetrates the partition board 31 and passes through a mist collecting pipe 34 to reach the mist storage chamber 33. Since the water storage chamber 32 and the mist storage chamber 33 are connected by means of the mist collecting pipe 34, the air supplied from the mist blower 50 promotes the rising of the mist in the pipe. The raised mist floats in the mist storage chamber 33. Since the mists having a large diameter collide with the upper plate of the mist storage chamber 33 and change into a water drops, only the mists in a small diameter (approximately 3 μm) keep floating. The mist diameter is acceptable when it is 30 μm or less, and preferable when 6 μm or less. The most desirable diameter is 3 μm or less.

On the peripheral wall of the mist storage chamber 33, a mist induction pipe 61 and a mist by-pass pipe 62 which penetrate the wall are fixedly provided (see FIG. 4). Moreover, a rotary solenoid 35 for rotating a shaft 35*a* is formed on the upper surface of the mist storage chamber 33. The shaft 35*a* is inserted in the mist storage chamber 33, and a pipe blocking plate 35*b* is provided at the end of the shaft 35*a*.

On the peripheral wall of the mist storage chamber 33, a mist induction pipe 61 and a mist by-pass pipe 62 which penetrate the wall are fixedly provided (see FIG. 4). Moreover, a rotary solenoid 35 for rotating a shaft 35*a* is formed on the upper surface of the mist storage chamber 33. The shaft 35*a* is inserted in the mist storage chamber 33, and a pipe blocking plate 35*b* is provided at the end of shaft 35*a*.

A mist heater 70 is formed and fixed on the inside surface of the side wall 4, and a mist induction pipe 61 is connected to the upper end of the mist heater 70. A hot mist induction pipe 63, which is connected to the lower end of the mist heater 70, is connected with the mist by-pass pipe 62 at the middle of the path. The hot mist induction pipe 63 has a form of the letter-L (see FIG. 3B), and it is held at a slight downward inclination toward the mist by-pass pipe 62. On the other hand, the mist by-pass pipe 62 is held at a slight upward inclination, and an upward L-shaped hose attachment 64 is connected to the other end of the mist by-pass pipe 62. When the pipe blocking plate 35*b*, in the mist storage chamber 33, is rotated by the rotary solenoid 35, an open end 61*a* of the mist induction pipe and an open end 62*a* of the mist by-pass pipe are alternatively closed (see FIG. 4). The 3 μm-diameter mist floating in the mist storage chamber 33 flows into either one of the mist induction pipe 61 or the mist by-pass pipe 62. The mist that flew into the mist by-pass pipe 62 directly reaches the hose attachment 64. The mist that flew into the mist induction pipe 63 reaches the hose attachment 64 by way of the mist heater 70 and the hot mist induction pipe 63. On the other hand, water drops collecting pipes 65*a* and 65*b* are respectively provided between the mist induction pipe 61 and the supplement water storage chamber 23 and between the mist by-pass pipe 62 and the chamber 23 (See FIG. 4). The water drops collecting pipes 65*a* and 65*b* are small diameter tubes for collecting the water drops in the supplement water storage chamber 23 when the mist is changed into the water drops in the above-mentioned pipes.

Moreover, the outside air blower 80, which is able to blow a large amount of air, is fixed to the plate 18 extending from the side wall 4 by means of an attachment 80*a*. An outside air blowing pipe 83 in the form of letter-L is connected to the casing 81 of the outside air blower 80 to provide an air path for feeding the air blown by a fan 82 rotating in the arrow direction shown in the figure (See FIG. 3C). The upper end of the outside air blowing pipe 83 is fixed in parallel with the hose attachment 64 of the mist by-pass pipe 62. Moreover, one end of the flexible outer hose 8 having the end cylindrical member 10 at the other end is attached so as to cover the upper end portions of the hose attachment 64 and the outside air blowing pipe 83. The flexible outer hose 8 stores in its inside the flexible mist hose 66 which is connected with the hose attachment 64 and extends to the end cylindrical member 10, and a flexible air hose 84 which is connected with the outside air blowing pipe 83 and extends to the end cylindrical member 10.

Figure 5B:
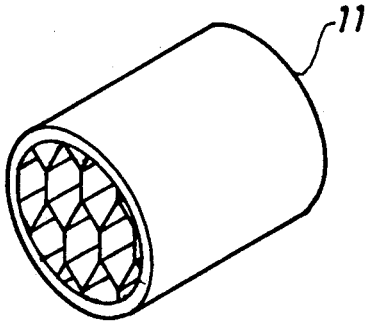
FIG. 5B is a perspective view thereof.

The end of the air hose 84 is fitted in a small air hose insertion hole 10*a* which penetrates the end cylindrical member 10 as shown in FIG. 5. The mist hose 66 penetrates the peripheral wall of the air hose 84 and is fixed in front of the position where the air hose 84 is fitted in the air hose insertion hole 10*a*. Namely, the inside of the above-mentioned both hoses are in communication with each other. Moreover, the end cylindrical member 10 is provided with a middle-size heater insertion hole 10*b* and a large-diameter attachment insertion hole 10*c*. In the heater insertion hole 10*b*, a known honeycomb constant temperature heater made of ceramics, i.e., a PTC heater 11, is inserted and fixed (see FIG. 5B). In the attachment insertion hole 10*c*, various attachments (to be described later) are removably inserted. On the other hand, the embodiment without adopting the PTC heater 11 is possible. A lead wire 11*a*, which is distributed from the control unit 16 of the upper seat 6 into the side wall 4 and the flexible outer hose 8, is connected with the PTC heater 11 in a small hole 10*d* which is formed toward the heater insertion hole 10*b*. This lead wire 11*a* is distributed from the flexible outer hose 8 to the above-mentioned small hole 10*d* through a groove 10*e* formed around the end cylindrical member 10. By supplying resins or the like into the small hole 10*d* and the groove 10*e*, it is possible to prevent unexpected movement of the lead wire 11*a* and to maintain an appropriate wiring condition.

By means of the above-mentioned constitutions, the air blown by the outside air blower 80 passes through the outside air blowing pipe 83, the air hose 84 and the PTC heater 11 of the end cylindrical member 10, and is blown out from the end cylindrical member 10. Accordingly, by blowing hot air heated by the PTC heater 11 as well as cool air from the end cylindrical member 10, the hair can be easily dried. On the other hand, the mist sent from the hose attachment 64 which is connected to the mist by-pass hose 62 passes through the mist hose 66 and enters into the air hose 84. Then, the mist is blown out from the end cylindrical member 10 independently or with the air passing through the air hose 84. Since the mist collides with the inner wall of the flexible mist hose 66 during passing through it, the mist having a large diameter becomes water drops in the mist hose 66. Accordingly, the uniformity of the mist diameter can be improved.

Figure 6:
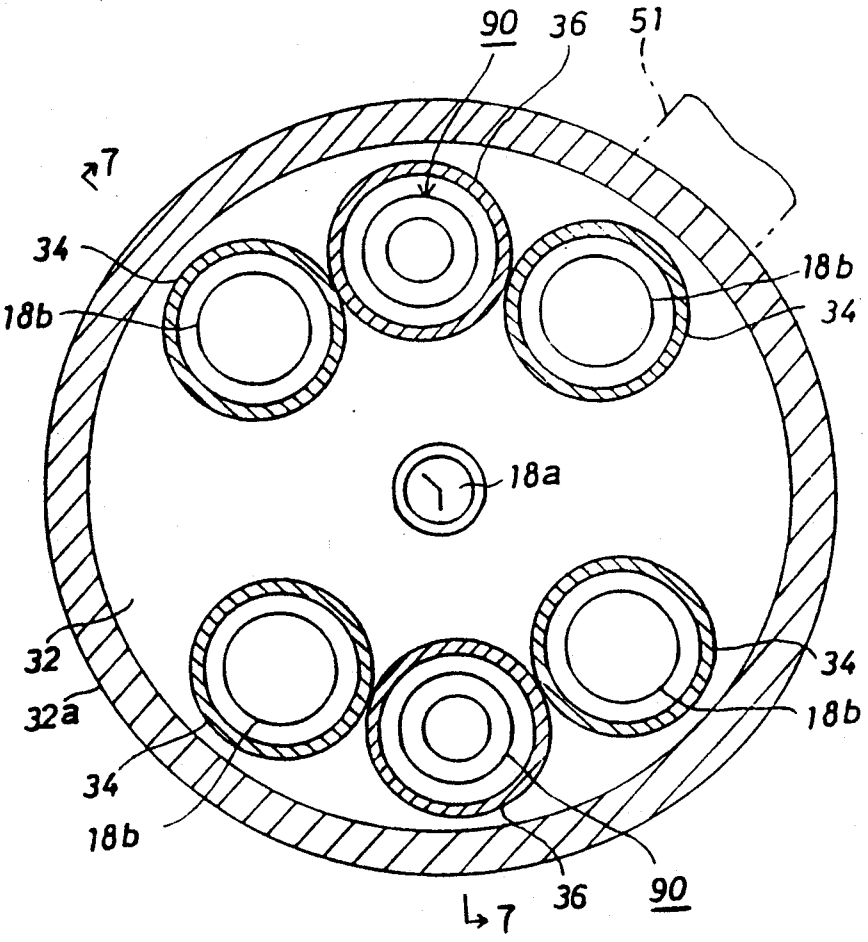
FIG. 6 is a sectional view taken along line 6—6 of FIG. 3A.
Figure 7:
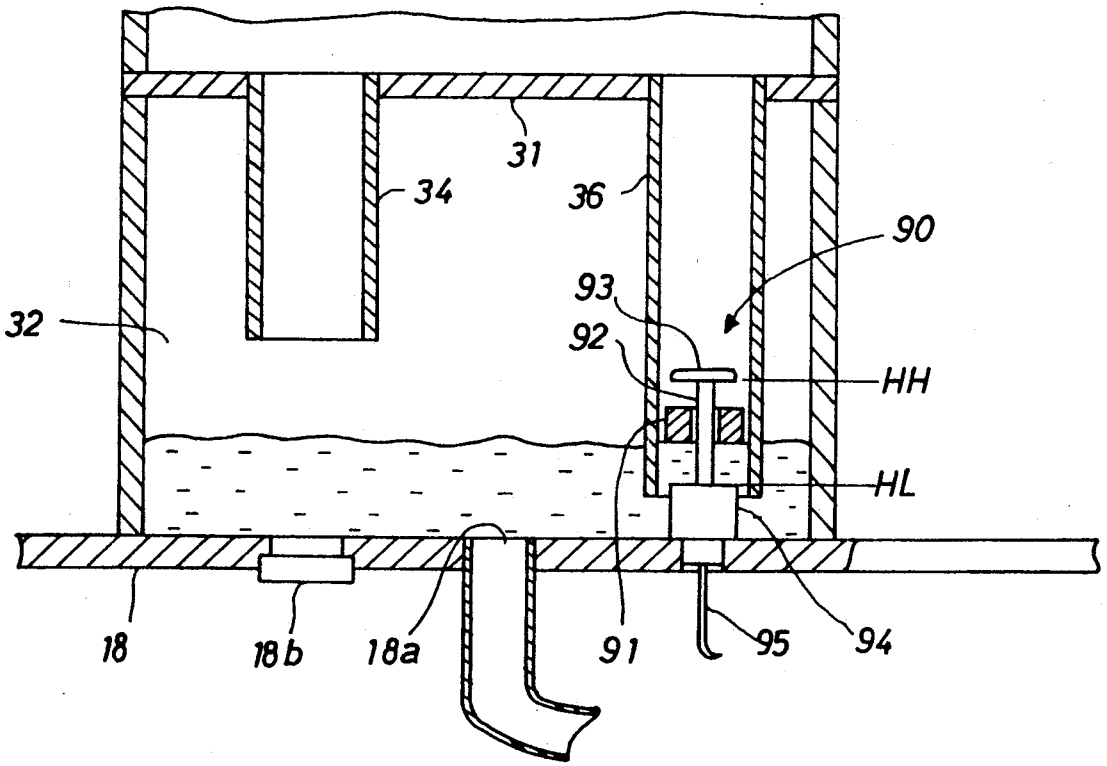
FIG. 7 is a sectional view taken along line 7—7 of FIG. 6.
Figure 8:
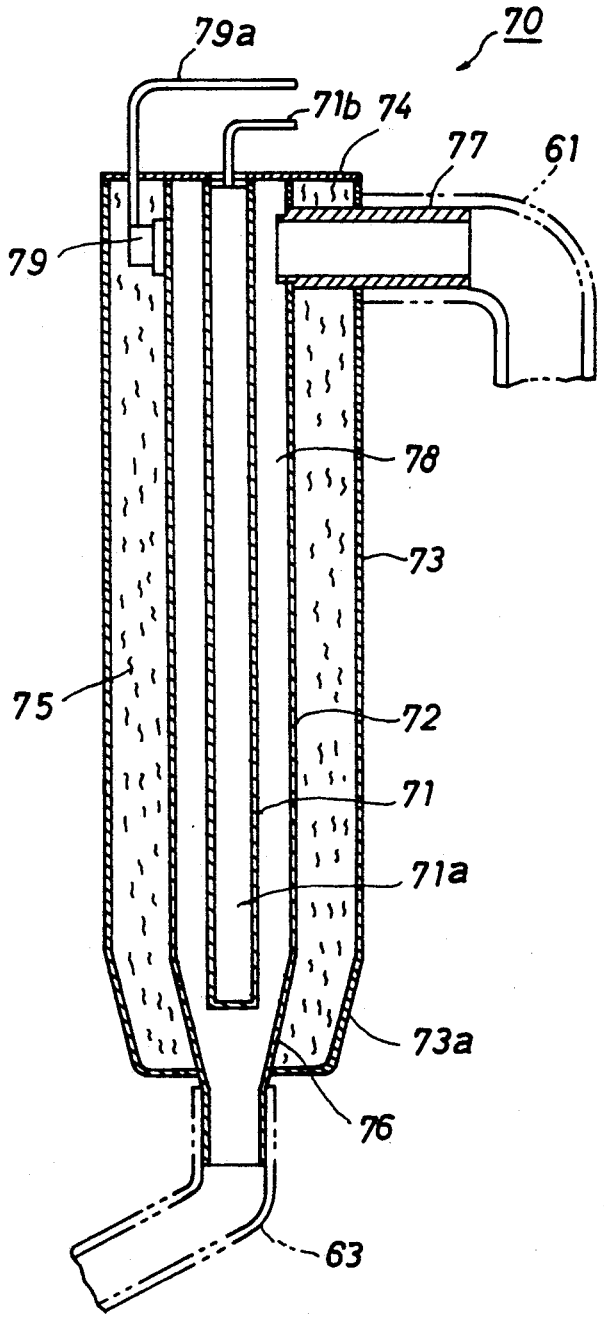
FIG. 8 is a sectional view taken along line 8—8 of FIG. 4.

Set forth below is the explanation of the mist generating tank 30 and the mist heater 70. FIG. 6 shows a cross-sectional view taken along line 6—6 of FIG. 3A. FIG. 7 is a cross-sectional view taken along line 7—7 of FIG. 6. FIG. 8 is a cross-sectional view taken along line 8—8 of FIG. 4.

The bottom surface of the water storage chamber 32 (shown in FIG. 6) corresponds to the upper surface of the plate 18, and the side wall is formed by a cylindrical pipe 32*a*. On a circumferential of the bottom surface, four pieces of ultrasonic vibration elements 18*b* are provided at a pitch of 90° in relation to the supplement water inlet 18*a* formed at the center of the bottom surface. Above the individual ultrasonic vibration elements 18*b*, mist collecting pipes 34 are formed with their center axes being identical with those of the elements 18*b*. The mist collecting pipes 34 penetrate the partition board 31 so as to connect the mist storage chamber 33 and the water storage chamber 32. As shown in FIG. 7, the position of the lower end of the mist collecting pipes 34 is higher than the maximum water level HH of the water level range, which is controlled based on the result of a water level detector 90 (see FIG. 7).

Two water surface dividing pipes 36, which penetrates the partition board 31, are provided on the above-mentioned circumference at a pitch of 180°. Those pipes 36 are positioned below the minimum water level HL of the water level range but short of the upper surface of the plate 18. Since the water surface in the water surface dividing pipe 36 is separated from the other water surface area, unexpected movement of the water surface caused by the movement of the mist blower 1, etc. rarely affects the water surface in the pipe 36. More specifically, the water level in the water surface dividing pipe 36 reflects the water level of the water storage chamber 32. Moreover, the water level detector 90 for detecting the water level of the water storage chamber 32 is fixed to the plate 18. The water level detector 90 detects the water level by means of a float 91 which reacts with the change in the water level of the water surface dividing pipe 36.

The water level detector 90 outputs a signal for indicating the maximum water level HH when the float 91 goes up and attains an upper head 93 of a float pillar 92, and outputs a signal for indicating the minimum water level HL when the float 91 goes down and attains a lower base 94. These signals are sent to the control unit 16 by a signal wire 95. Based on the detected result, the control unit 16 controls the ultrasonic vibration elements 18*b*. In detail, based on the detected result of the water level detector 90, the control unit 16 reads three grades of the water level, i.e., "High level", "Normal level" and "Low level", and informs the operator of the water level by turning on and off an indicator such as LED (not shown) or actuating a buzzer or the like. Moreover, the control unit 16 actuates or stops the ultrasonic vibration elements 18*b* to control the volume of the mist to be generated by correlating the above-mentioned detected result with the water level of the water storage tank 32 in high accuracy. It is, therefore, possible to prevent the damage of the ultrasonic vibration elements 18*b* and to render uniform the diameter of the mist particles to be generated.

The explanation of the mist heater 70 is set forth below with reference to FIG. 8. The mist heater 70 consists of a first, a second, and a third cylindrical members 71, 72 and 73. Those cylindrical members are arranged so they have a common axis. One end of each the individual long cylindrical members are connected with a circular end plate 74. The first cylindrical member 71 is built within the second cylindrical member 72, and the second cylindrical member 72 is built within the third cylindrical member 73. Each cylindrical member is fixed to the other cylindrical members. In the first cylindrical member 71, made of brass, a bar heater 71*a* having almost same length as the first cylindrical member 71 is inserted. At a distal end of the third cylindrical member 73, a closed bowl 73*a*, which makes a closed cylindrical space between the second cylindrical member 72 and the third cylindrical member 73, is connected. This cylindrical space is filled with heat insulating material. At the other end of the second cylindrical member 72, a funnel-shaped hot mist exhaust pipe 76 is attached in the manner that its narrow-mouthed portion penetrates the closed bowl 73*a*. Moreover, one end of the hot mist induction pipe 63 is connected to the narrow-mouthed portion of the hot mist exhaust pipe 76.

A mist flowing pipe 77, which functions as an attachment of the mist induction pipe 61, is installed near the end plate 74 in the second cylindrical member 72 so as to penetrate the second and the third cylindrical members in their radial directions. Moreover, a temperature sensor 79 for detecting the temperature of a cylindrical mist path 78*a*, i.e., a space between the external surface of the first cylindrical member 71 and the inner surface of the second cylindrical member 72, is formed in the same side of the second cylindrical member 72. Since the inner diameter of the mist flowing pipe 77 is smaller than that of the second cylindrical member 72, it takes time to pass the mist through the cylindrical mist path 78. As a result, the mist is appropriately heated. On the other hand, a lead wire 71*b* for supplying current to a signal wire 79*a*, connected to the temperature sensor 79 and to the bar heater 71*a*, is distributed to the control unit 16. The control unit 16 controls the air blowing amount of the mist blower 50 and the pre-heating of the bar heater 71*a* as well as the volume of the mist to be generated and the heating of the bar heater 71*a*. Accordingly, the hot mist, which is heated up to a desired temperature by the mist heater 70, or unheated cold mist passes through the flexible mist hose 66, and blown out from the end cylindrical member 10 independently or with the above-mentioned hot air or cool air. It is, therefore, possible to easily execute moistening, dressing, or drying the hair by the hot air including mist, while preventing excessive drying of the hair.

As described in the above, the mist blower 1 of the present embodiment is equipped with the outside air blower 80 for blowing a large amount of air taken from the outside, the flexible air hose 84 for sending the air to the end cylindrical member 10, and the end cylindrical member 10 in which the PTC heater 11 is inserted in the through hole. Accordingly, it is possible to easily dry the hair by blowing hot or cool air from the end cylindrical member 10. Moreover, the mist blower 1 includes the mist generating tank 30 which can easily control the particle diameter of the mist to be extremely small (3 μm approx.) in comparison with steam particles by actuating the ultrasonic vibration elements 18*b*, and also includes the flexible mist hose 66 for sending the hot mist heated by the mist heater 70 or unheated cool mist blown by the mist blower 50 to the end cylindrical member 10. It is, therefore, possible to moisten the hair by spraying the micro-diameter hot or cool mist independently or with the hot or cool air. Such construction of the mist blower 1 provides some advantages. First, even an inexperienced person can easily dress or dry the hair while keeping the moisture around the hair by using the hot air including the mist. Accordingly, excessive drying of the hair can be prevented and the appropriate hair moisture content can be maintained by permeating the micro-diameter mist into the hair even in the drying operation. As a result, damage such as splitting and tearing of the hair can be prevented. It is also effective to increase the efficiency in hairdressing of dry kinky hair and to finish the hair in a moist condition.

Figure 9:
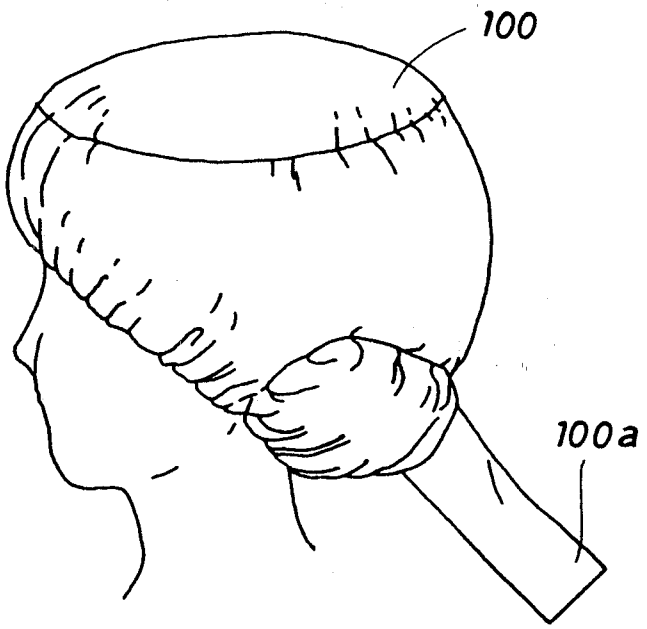
FIGS. 9 and 10 are the drawings for explaining the method of application.

Moreover, since the heating condition of the bar heater 71*a* is controlled by the temperature sensor 79 of the mist heater 70, the mist can be maintained at a desired temperature. Therefore, safety can be assured without fear of getting scalded by the hot steam, and the mist controlled at the temperature suitable for usage can be sprayed to the hair. Accordingly, the elasticity of the hair will not be excessively decreased. For example, by using a steam cap 100 made of a thin film of nylon, etc., as shown in FIG. 9, it is possible to apply curling without deteriorating elasticity of the hair during perming.

In this case, an attachment 100*a* of the steam cap 100 is inserted in an attachment insertion hole 10*c* of the end cylindrical member 10. Then, the mist at the desired temperature is supplied to inflate the steam cap 100, so that the inside of the steam cap 100 is controlled at the temperature and the humidity appropriate to the hair. Thus, the hair is curled without deteriorating its elasticity. Since the steam cap 100 is made of a thin film and it is very light, it is possible to freely move the head so that the fatigue of the neck can be lightened, though in a conventional hard hood the position of the head is intentionally fixed. Moreover, since the minute-diameter mist improves the permeability of the treatment liquid or the perming liquid into the hair, beautiful finishing can be realized.

In addition to the above-mentioned effects, the mist blower 1 of the present embodiment provides excellent advantages as set forth below.

First, since the weight of the end cylindrical member 10 is light, the load applied to the wrist and the arm of the hairdressing operator can be lightened.

Second, since the mist is often sprayed on the hand of the hairdressing operator, the skin of the hand of the operator can be protected from drying.

The supplement water storage chamber 23 of the water tank 20 communicates with the water storage chamber 32, so that the water levels of the both chambers are same. When the mist blower 1 is moved, therefore, the same motion, i.e., ripple is generated on the water surface. Such motion of the water surface can be prevented in this embodiment. At the upper end of the supplement water storage chamber 23, an intermediate plate 21 is provided a little interval left from the maximum water level HH. This intermediate plate 21 restrains the motion of the water surface in the supplement water storage chamber 23, thereby also controlling the motion of the water surface in the water storage chamber 32.

Since the water supply/drain pipe 40 connects the water tank 20 and the mist generating tank 30 under the plate 18, i.e., at the portion lower than the bottom surface, it is possible to prevent hair and dust in the water tank 20 from flowing into the mist generating tank 30. Accordingly, the mist can be constantly generated from the mist generating tank 30. Moreover, since hair and dust can be easily removed from the drain valve 43, maintenance operations such as exchange of the water can be easily carried out.

The mist generating tank 30 is equipped with the mist storage chamber 33. The generated mist passes through the mist collecting pipe 34 and flows into the mist storage chamber 33. Then the mist is sent from the side surface of the mist storage chamber 33 by means of the mist by-pass pipe 62. Since the mist having a large particle diameter collides with the upper surface of the mist storage chamber 33 and changes into the water drops, only the mist having a small particle diameter is sent into the mist conducting pipe 61 or the mist by-pass pipe 61 with the air sent by the mist blower 50. Also in the flexible mist hose 66, the mist in a large diameter collides with the inner surface of the mist hose 66 and changes into the water drops. Accordingly, only the mist in a more uniform minute-diameter can be selected by passing the mist through the mist hose 66.

Moreover, the mist generating tank 30 of the mist blower 1 of the present embodiment is equipped with the water storage chamber 32 and the mist storage chamber 33 which are divided into the upper and the lower parts by the partition board 31. The water storage chamber 32 and the mist storage chamber 33 partially communicate with each other by means of the mist collecting pipe 34, which is formed such that it penetrates the partition board 31. Therefore, the air flow passing upward through the mist collecting pipe 34 becomes a winding air flow from the upper end of the mist collecting pipe 34 in the mist storage chamber 33. Moreover, since the air is sent by the air blower 50 into the water storage chamber 32, the above-mentioned air flow obtains force from the air. The mist generated by the vibration of the ultrasonic vibration elements **18*b*, therefore, is sent by the forced air flow into the mist collecting pipe 34 and flows into the mist storage chamber 33 (see FIG. 3A). Then the mist floats in the mist storage chamber 33 with the above-mentioned winding air flow. On the other hand, the mist particles in a large diameter collide with the upper plate or the side wall of the mist storage chamber 33 because of their mass and surface area, or collide with the bottom surface during floating in the mist storage chamber 33, and change into water drops. Namely, in the mist generating tank 30, only the uniformed minute-diameter mist particles are selected and blown out with the air sent by the mist blower from the side surface of the mist storage chamber 33 into the mist conducting pipe 61 or the mist by-pass pipe 62. Among the mist particles flown into the flexible mist hose 66, the large-diameter mist particles collide with the inner surface of the mist hose 66 and change into water drops. Namely, only the uniformed minute-diameter mists are selected and blown out from the end cylindrical member 10**.

Moreover, the water tank 20 for supplying water to the mist generating tank 30 is equipped with the supplement water storage chamber 23 for storing the water supplied from the water supply container 24. The supplement water storage chamber 24 and the water storage chamber 32 of the mist generating tank 30 are connected under the plate 18 by means of the water supply/drain pipe 40. Namely, these two chambers 24 and 32 communicate under the bottom surfaces. Accordingly, hair and dust are collected in the communicating path 41 of the water supply/drain pipe 40 or in the drain pipe 42, and only the water flows from the water tank 20 into the mist generating tank 30. Namely, the hairs and the dust that prevent the vibration of the ultrasonic vibration element **18*b* from being transmitted to the water do not exist in the water stored in the mist generating tank 30. It is, therefore, possible to stably generate the mist from the mist generating tank 30. Moreover, maintenance operations such as exchange of water can be easily executed because hair and dust can be easily removed from the drain valve 43**.

On the other hand, the water surface dividing pipe 36, one end of which is sinking in the water of the storage chamber 32, functions to separate the water surface within the pipe from other areas and to stabilize the displacement of the water surface in the pipe (see FIG. 7). The water level detector 90 detects the water level in the water surface dividing pipe 36 as the water level of the mist generating tank 30. Accordingly, the water level detector 90 excludes the change in the water level caused by a temporary movement of the mist blower 1, i.e., the change in the water level in which the actual water storage amount in the water storage chamber 32 is not reflected, and accurately detects the water storage amount in the water storage chamber 32. Based on this result, the actuating control of the ultrasonic vibration element **18*b* can be accurately executed by the control unit 16 in corresponding to the water storage amount of the water storage chamber 32. The ultrasonic vibration element 18*b* provides the ultrasonic vibration, i.e., the ultrasonic energy, to the water to generate the mist from the surface of the water. In this sense, the distance from the water surface exerts a remarkable effect upon the atomization characteristics. Namely, the control of the ultrasonic vibration element corresponding to the water level is important to generate the mist in a uniform diameter. In the method of the present embodiment for controlling the ultrasonic vibration element 18*b*, the diameter of the mist can be uniformed when the mist is generated, so that the damage of the ultrasonic vibration element 18*b* can be prevented. On the other hand, since the supplement water storage chamber 23 of the water tank 20 and the water storage chamber 32 communicate with each other, the water levels of the both water storage chambers are the same. When the mist blower 1 is moved, therefore, the same wave motion occurs in the both chambers. However, the movement of the water surface in the supplement water storage chamber 23 is controlled by the intermediate board 21 which is provided at the upper end of the supplement water storage chamber 23 a little distance apart from the maximum water level HH. Consequently, the motion of the water surface in the water storage chamber 32 is also controlled. Thus, the water surface in the water storage chamber 32** is stabilized, and the uniformity of the mist particle diameter can be promoted.

As described in the above, the mist blower 1 of the present embodiment selects the generated mist and changes the large-diameter mist particles into water drops to exclude them. Moreover, the mist blower 1 prevents the inclusion of hair, etc., which may interrupt the transmission of the vibration generated by the ultrasonic vibration elements **18*b*. In addition, the water storage amount can be maintained at a constant level, so that the actuating control of the ultrasonic vibration elements 18*b* can be realized with high accuracy in corresponding to the constant water level. Thus, the mist particles, the diameter of which is uniformed at approximately 3 μm, can be blown out from the end cylindrical member 10**.

Moreover, the mist blower 1 provides excellent effects in the protection of hair and the maintenance of the gloss of the hair by supplying the mist (moisture) into the hair to maintain the appropriate moisture content even in drying the hair.

The atomizer of the present invention is not necessarily limited to the above-mentioned embodiment. Various modifications and variations may be possible without departing from the spirit and scope of the invention. To use a conventional hand dryer, for example, the outside air blower 80 and the relative parts such as air hose 84, and the PTC heater 11 of the end cylindrical member 10 may be excluded from the atomizer of the above-mentioned embodiment. Such construction is preferable in reducing the manufacturing cost. In the atomizer having such construction, an attachment of the end cylindrical member 10 is set near the blow-out hole of the hand dryer, and the mist is mixed in hot air or cool air blown out from the hand dryer. Moreover, operational efficiency in hair dressing can be improved by installing the power supply of the hand dryer in the atomizer and by linking the ON/OFF switch of the hand dryer with that of the ultrasonic vibration elements.

The mist heater 70 is composed of the long first cylindrical member 71 provided along the direction in which the mist passes and the bar heater 71*a* inserted in the first cylindrical member 71. The cylindrical mist path 78 which is formed along the bar heater 71*a* is also long, so that the time for passing the mist through the cylindrical mist path 78 is long. Accordingly, the mist passing through the cylindrical mist path 78 is heated up to a desired temperature without the fear of scalding by the bar heater 71*a* which can control the heating condition. Then, the mist is blown out from the end cylindrical member 10 as the hot mist while keeping the temperature. The cylindrical mist path 78 is a cylindrical space composed of the first cylindrical member 78 and the second cylindrical member 72. In this cylindrical space, the mist flowing pipe 77 is provided at a certain angle (90° in this embodiment) to the peripheral wall of the second cylindrical member 72. Namely, the path for passing the mist is bent from the outlet of the mist flowing pipe 77. Consequently, the motion of the mist entered from the mist flowing pipe 77 into the cylindrical mist path 78 is changed to spirally move in the cylindrical mist path 78 toward the hot mist exhaust pipe 76. Since it takes time for the mist to pass through the cylindrical mist path 78, the mist can be efficiently heated at a predetermined temperature. Moreover, the spiral movement of the mist can be promoted by setting the mist flowing pipe 77 to be offset in relation to the center axis of the second cylindrical member 72. The inner diameter of the mist flowing pipe 77 is smaller than the effective diameter of the cylindrical mist path 78, i.e., the inner diameter of the second cylindrical member 72. Accordingly, the traveling speed of the mist entered from the mist flowing pipe 77 into the cylindrical mist path 78 is reduced. As a result, the time for passing the mist through the cylindrical mist path 78 is extended, so that the mist can be efficiently heated. Since the funnel-shaped hot mist exhaust pipe 76 with a narrow-mouthed portion whose diameter is smaller than that of the cylindrical mist path 78 is provided at the end of the cylindrical mist path 78, the mist stays in the cylindrical mist path 78, thereby the time for passing the mist through the cylindrical mist path 78 can be extended. Thus, the mist can be efficiently heated. If a throttle for changing the sectional area of the path is provided at the narrow-mouthed portion of the hot mist exhaust pipe 76, the time for passing the mist can be controlled. Accordingly, the heating of the mist can be executed even by reducing the heating time, i.e., the power supplying time by the bar heater 71*a*, which results in energy saving.

The mist hose 66 for inducting the mist into the end cylindrical member 10 is connected to the air hose 84. When the air flows in the air hose 84, load is applied to the upper connecting portion. This load functions to blow out the mist in the mist hose 66 from the end cylindrical member 10 with the air sent by the outside air blower 80. Thus, the operating time of the mist blower 50 attached in the mist generating bath 30 can be reduced, which also enables energy savings.

Figure 10A:
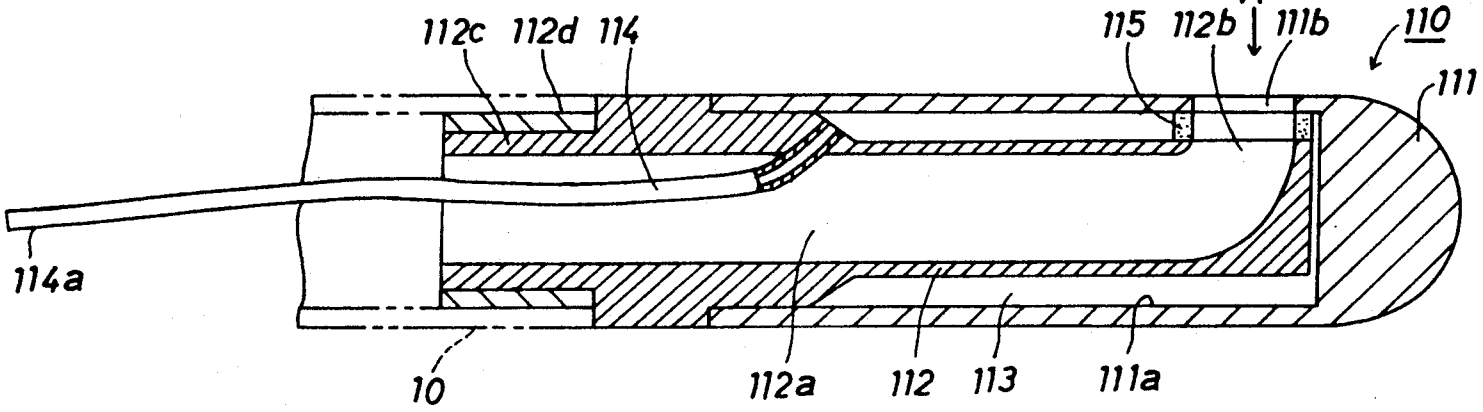
Figure 10B:
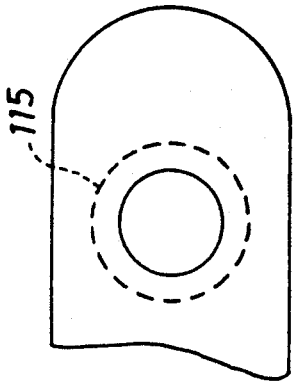

Moreover, since the mist blower 1 of the present embodiment is able to blow out the air including the mist at a predetermined temperature, it is also available to a facial treatment steamer, the so-called facial steamer for applying moisture to the facial skin as well as the purpose of hair dressing. FIG. 10 shows a sectional view and a view in the direction of arrow A of a facial nozzle 110 to be attached to the end cylindrical member 10 when the mist blower 1 is used as a facial steamer.

A cap 111 of the facial nozzle 110 is a cylindrical member having a semi-spherical end and a deep hole 111*a* in its center. Around the peripheral wall of the cap 111 near the bottom of the deep hole 111*a*, a mist blow-out hole 111*b* is formed. In the deep hole 111*a*, a mist blow-out pipe 112 is fixedly inserted, and a closed cylindrical space 113 is formed between the inner surface of the cap 111 and the outer surface of the mist blow-out pipe 112. An L-shaped through hole 112*a* is formed in the mist blow-out pipe 112, and an outlet 112*b* of the through hole 112*a* is facing to the mist blow-out hole 111*b* of the cap 111. Moreover, a bearing member 112*d* is engaged in an end portion 112*c* of the mist blow-out pipe 112. The facial nozzle 110 is attached to the end cylindrical member 10 of the mist blower 1 by means of the bearing member 112*d*. One end of a water drops drain pipe 114 installed in the through hole 112*a* of the mist blow-out pipe 112 penetrates the peripheral wall of the mist blow-out pipe 112, and reaches the above-mentioned cylindrical space 113 so as to connect this space and the outside. The length of the water drops drain pipe 114 is controlled so that the other end 114*a* is inserted into the end cylindrical member 10 and reaches the mist hose 66 when the facial nozzle 110 is attached to the end cylindrical member 10. Moreover, a cushion member 115 having continuous air bubbles is put between the outlet 112*b* and the mist blow-out hole 111*b*.

The facial steamer is used by holding the facial nozzle 110 with a hand and spraying unheated cold mist or hot mist controlled at a predetermined temperature blown out from the mist blow-out hole 111*b* onto the face to apply moisture to the facial skin.

Since the facial nozzle 110 is freely rotatable by the bearing member 112*b*, no twisting force is applied to the end cylindrical member 10. Accordingly, the air hose 84 is never twisted. When the mist is changed to the water drops near the outlet 112*b* of the through hole 112*a*, the cushion member 115 holds the water drops in its continuous air bubbles, so that the water drops will never leak from the mist blow-out hole 111*b*. Moreover, the water drops collected in the continuous air bubbles are withdrawn or drained by the water drops drain pipe 114, so that the leakage of the water drops from the mist blow-out hole 111*b* can be surely prevented.

On the other hand, by mixing deodorant or fragrance into the supplement water, it is possible to remove the smell of the perming liquid during perming, or apply fragrance to the hair.

The present invention is not limited to the above-mentioned embodiment. Various other changes in form and modifications may be made without departing from the spirit and scope of the invention. For example, it is possible to provide a filter made of absorbent to absorb the medicinal element of the perming liquid, the treatment liquid and the hair dying liquid as well as minute dusts, etc. at the bottom of the supplement water storage chamber 23 in which the water drops flow by means of the water drops collecting pipes 65*a* and 65*b*. By installing such a filter, purified water can be constantly applied to the water storage chamber 32.

FIELD OF INDUSTRIAL APPLICATION

As described in detail hereinbefore, in the atomizer for hairdressing of the present invention, the liquid particles having a few μm diameter or less generated by the ultrasonic vibration can be controlled at a predetermined temperature, and the liquid particles can be blown out independently or with hot or cool air.

With this equipment, the dressing and drying of the hair can be easily executed while keeping the moisture of the hair. Even in the hair drying operation, the humidity around the hair can be constantly maintained in an appropriate condition. Consequently, excessive drying of the hair can be prevented, and the moisture content in the hair can be maintained at an appropriate condition by constantly supplying moisture into the hair. Namely, it is possible to protect the hair from damage such as tearing and splitting of the hair, and also to increase the efficiency in the hair dressing operation. Moreover, it is quite safe because there is no fear of being scalded. Furthermore, since the liquid particles controlled at an appropriate temperature, corresponding to the individual usage such as perming, etc., can be sprayed to the hair, it is possible to prevent deterioration of elasticity of the hair. The atomizer of the present invention has a wide range of uses such as perming, coloring, treatment, nourishment of the hair, blow finishing, facial steamer, etc. Moreover, if this atomizer is used as a humidifying equipment, it is possible to provide humidity without reducing the room temperature. When it is used as a fuel injection equipment, the time required for ignition can be reduced.

I claim:

1. An atomizer for hairdressing comprising:

an air feeding means for intaking air and for forcibly feeding the air;

an air ventilation means composed of a flexible member for forming an air path in which air is sent by the air feeding means;

an end heating means for optionally heating the air passing through the air path, which is provided at a blow-out hole of the air sent by the air feeding means;

a liquid particle generating means being equipped with an electricity-mechanical power conversion element for oscillating a collected liquid to generate micro-size diameter liquid particles from the surface of the collected liquid by means of the vibration of the electricity-mechanical power conversion element; and a liquid particles heating and inducting means which is provided between the liquid particle generating means and the air ventilating means for optionally heating the liquid particles generated by the liquid particle generating means and for inducting the liquid particles into the path of the air ventilating means.

2. An atomizer as claimed in claim 1, further comprising:

a supplement storing means for storing liquid to supplement the liquid stored in the liquid particle generating means;

a water level detection means for detecting the water level of the stored liquid; and a conversion element control means for controlling the actuation of the electricity-mechanical power conversion element of the liquid particle generating means based on the result of the water level detection means;

a space dividing means which forms a dividing portion for dividing the space above the surface of the liquid stored in the liquid tank into an upper space and a lower space;

a path constructing means for constructing a path which penetrates the dividing portion to partially connect the upper space and the lower space;

an air supplying means for supplying air to the lower space; and a blow-out hole being formed on the side wall of the liquid tank for directly connecting the upper space and the outside air.

3. An atomizer as claimed in claim 1, further comprising:

a supplement storing means for supplementing liquid to the liquid stored in the liquid particle generating means;

a water level detection means for detecting the water level of the stored liquid; and a conversion element control means for controlling the actuation of the electricity-mechanical power conversion element of the liquid particle generating means based on the result of the water level detection means; wherein the supplement means includes a supplement water storage portion for storing the liquid to be supplemented to the liquid tank of the liquid particle generating means;

a supplement liquid path extending from the portion below the bottom of the liquid tank to the liquid tank to supply the liquid to the tank;

a supplement water pumping portion, which is provided between the supplement water path and the supplement water storage portion, for forcibly feeding the liquid stored in the supplement water storage portion into the supplement water path in response to a predetermined water level in the liquid tank; and an open/close drain pipe which is connected to the lowest portion of the supplement water path.

4. An atomizer as claimed in claim 3, further comprising:

a supplement means for supplementing liquid to the liquid particle generating means;

a water level detection means for detecting the water level of the stored liquid; and a conversion element control means for controlling the actuation of the electricity-mechanical power conversion element of the liquid particle generating means based on the result of the water level detection means; wherein the water level detection means includes a wave motion interrupting portion for interrupting the wave motion generated on the surface of liquid stored in the liquid tank from spreading within a predetermined range of the liquid surface; and a water level detecting portion for detecting the water level in the predetermined range of the wave motion interrupting motion.

5. An atomizer as claimed in claim 1, further comprising:

a liquid particle blowing means for inducting the liquid particles generated by the liquid particle generating means into a blowing path and for blowing out the particles from a blow-out hole with an air flow in the path; and a long heating means being arranged along the blowing path of the liquid particle blowing means.

* * * * *